US007347782B2

(12) United States Patent
Hilbert

(10) Patent No.: US 7,347,782 B2
(45) Date of Patent: Mar. 25, 2008

(54) PAPER MOTION DETECTOR IN A GAMING MACHINE

(75) Inventor: John Hilbert, Torrance, CA (US)

(73) Assignee: FutureLogic, Inc., Glendale, CA (US)

( * ) Notice: Subject to any disclaimer, the term of this patent is extended or adjusted under 35 U.S.C. 154(b) by 528 days.

(21) Appl. No.: 10/640,495

(22) Filed: Aug. 12, 2003

(65) Prior Publication Data

US 2006/0033261 A1 Feb. 16, 2006

Related U.S. Application Data

(60) Provisional application No. 60/402,820, filed on Aug. 12, 2002.

(51) Int. Cl.
*A63F 13/00* (2006.01)

(52) U.S. Cl. ..... 463/47; 463/46

(58) Field of Classification Search ..... 463/25, 463/46–47; 400/708
See application file for complete search history.

(56) References Cited

U.S. PATENT DOCUMENTS 4,982,337 A * 1/1991 Burr et al. ..... 700/235
5,282,121 A * 1/1994 Bornhorst et al. ..... 362/294
5,588,762 A * 12/1996 Suzuki ..... 400/582
5,739,653 A * 4/1998 Coy ..... 318/560
5,879,092 A * 3/1999 Brannan et al. ..... 400/708
6,174,234 B1 * 1/2001 Seibert et al. ..... 463/20
6,524,230 B1 * 2/2003 Harding et al. ..... 493/8
6,547,464 B1 * 4/2003 Lewis et al. ..... 400/613
6,648,761 B1 * 11/2003 Izawa et al. ..... 463/25
6,875,105 B1 * 4/2005 Behm et al. ..... 463/17

* cited by examiner

*Primary Examiner*—John M. Hotaling, II
(74) *Attorney, Agent, or Firm*—Fitzpatrick, Cella, Harper & Scinto

(57) ABSTRACT

A paper jam detector for a gaming machine. A paper jam detector is integrated with a gaming machine printer that produces cash-out paper vouchers, print-on-demand player tracking cards, or tickets. A paper jam detector may be entirely self-contained and include all of the mechanical, electrical, electronic, and software components used to detect a paper jam and communicate with a gaming machine or a host. A paper jam detector may also be distributed throughout a gaming machine printer, thereby utilizing various components of the gaming machine printer's printing mechanism and control module. The paper jam detector detects paper jam conditions by monitoring the movement of the paper through the mechanical portions of the gaming machine printer and signals to the gaming machine printer, gaming machine, or host when a paper jam occurs.

20 Claims, 9 Drawing Sheets

PAPER MOTION DETECTOR IN A GAMING MACHINE

CROSS-REFERENCE TO RELATED APPLICATION

This application claims the benefit of U.S. Provisional Patent Application No. 60/402,820, filed Aug. 12, 2002 which is hereby incorporated by reference as if fully stated herein.

BACKGROUND

This invention relates generally to gaming printers and more specifically to printers for use in cashless gaming machines that produce cash-out paper vouchers or print-on-demand player tracking card/vouchers.

The gaming machine manufacturing industry provides a variety of gaming machines for the amusement of gaming machine players. An exemplary gaming machine is a slot machine. A slot machine is an electromechanical game wherein chance or the skill of a player determines the outcome of the game. Slot machines are usually found in casinos or other more informal gaming establishments.

Gaming machine manufacturers have more recently introduced cashless enabled games to the market and these have begun to find wide acceptance in the gaming industry. Cashless enabled games are so named because they can conduct financial exchanges using a mixture of traditional currencies and vouchers. Typically, a cashless enabled game has a gaming printer to produce vouchers and a bill acceptor that supports automatic reading of vouchers. To coordinate the activities of multiple cashless enabled games, one or more cashless enabled games may be electronically coupled to a cashless enabled game system that controls the cashless operations of a cashless enabled game.

When a player cashes out using a cashless enabled game coupled to a cashless enabled game system, the cashless enabled game signals the system and the system may determine the type of pay out presented to the player. Depending on the size of the pay out, the cashless enabled game system may cause the cashless enabled game to present coins in the traditional method of a slot machine, or the cashless enabled game system may cause a gaming printer in the cashless enabled game to produce a voucher for the value of the pay out. The voucher may then be redeemed in a variety of ways. For example, the voucher may be redeemed for cash at a cashier's cage or used with another cashless enabled game. In order to use the voucher in a cashless enabled game, the voucher is inserted into a bill acceptor of another cashless enabled game at a participating casino and the cashless enabled game system recognizes the voucher, redeems the voucher, and places an appropriate amount of playing credits on the cashless enabled game.

Cashless enabled games have found an increasing acceptance and use in the gaming industry, both with players who enjoy the speed of play and ease of transporting their winnings around the casino and casinos who have realized significant labor savings in the form of reduced coin hopper reloads in the games, and an increase in revenue because of the speed of play. Practical field experience with printers used in cashless enabled games has illustrated that there are areas for improvement in the current printer designs and implementation. These areas in need of improvement include methods and means of detecting paper jam events.

A paper jam can occur for a number of reasons. Various schemes for dealing with paper jams in existence today rely on either containing the voucher until completely printed or declaring a paper jam if the voucher does not reach a sensor in a certain amount of time. One short fall of these schemes is that the printing process normally continues after the paper jam occurs, thus creating a partially printed or otherwise undesirable printed cash out ticket or voucher. Next, the paper jam normally requires an attendant or technician to travel to the gaming machine and physically remove the voucher.

Therefore, a need exists for a paper jam detector that can detect a paper jam easily and quickly within a normal voucher printing event. The paper jam detector should make a decision to stop printing or provide paper jam information to a gaming machine or host for decision making. Various aspects of the present invention meet such a need.

SUMMARY OF THE INVENTION

In one aspect of the invention, a paper jam detector is integrated with a gaming machine printer that produces cash-out paper vouchers, print-on-demand player tracking cards or vouchers. A paper jam detector may be entirely self-contained and include all of the mechanical, electrical, electronic, and software components used to detect a paper jam and communicate with a gaming machine or a host. A paper jam detector may also be distributed throughout a gaming machine printer, thereby utilizing various components of the gaming machine printer's printing mechanism. The paper jam detector detects paper jam conditions by monitoring the movement of the paper through the mechanical portions of the gaming machine printer and signals to the gaming machine printer, gaming machine, or host when a paper jam occurs.

In another aspect of the current invention, the paper jam detector includes a paper movement detector for detecting paper movement created by printing or feeding of paper stock by the printing mechanism. The paper movement is detected by a roller, wheel, or other means that contacts the paper in such a manner that as the paper moves, the roller rotates. The roller includes an interface to a sensor that translates the movement of the roller into a paper movement signal. The movement signal is transmitted to s control module. The control module processes the paper movement signal by interpreting the paper movement signal to generate a paper jam signal.

In another aspect of the invention, the paper movement signal includes a component indicating the direction of the paper movement.

In another aspect of the invention, the paper movement signal includes a component indicating the speed of the paper movement.

In another aspect of the invention, the roller is coupled to an articulating mechanism allowing the roller to articulate away from or toward the path of the paper. The roller is further coupled to a sensor interface allowing a sensor to detect the articulation and generate an articulation signal. The articulation signal is transmitted to the control module and used to determine the presence or absence of the paper.

In another aspect of the invention, the paper jam detector, includes means for detecting the movement of the paper drive mechanism included in the printing mechanism. Movement of the paper drive mechanism is detected by a roller, wheel or other means that is mechanically coupled to the paper drive mechanism of the printing mechanism. As the movement occurs the roller turns. The roller includes an interface to a sensor. The sensor senses the movement of the roller and translates the movement into a paper drive signal.

The paper drive signal is received by the control module. The control module interprets the paper drive signal to determine if the paper is moving.

In another aspect of the invention, the paper drive signal includes a direction component that may be used to determine the direction of movement of the paper drive mechanism.

In another aspect of the invention, the paper drive signal includes a direction component that may be used to determine the direction of movement of the paper drive mechanism.

In another aspect of the current invention, paper movement is detected by using an optical scanning device that reads the presence of a series of index marks on the paper. The index marks may be pre-printed on the paper or printed by the printing mechanism as the paper moves. As the paper moves, the optical sensor translates the paper movement into a paper movement signal. The paper movement signal is received by the control module of the printing mechanism. The control module interprets the paper movement signal to determine if the paper is moving.

In another aspect of the invention, the paper movement signal includes a component indicating the direction of the paper movement.

In another aspect of the invention, the paper movement signal includes a component indicating the speed of the paper movement.

BRIEF DESCRIPTION OF THE DRAWINGS

These and other features, aspects, and advantages of the present invention will become better understood with regard to the following description, appended claims, and accompanying drawings where:

DETAILED DESCRIPTION

For the purposes of this document, the following definitions apply:

"Casino"—A casino in the traditional sense, or other place where gambling takes place.

"Gaming Machine, Slot Machine, or Slot"—A casino electro-mechanical game of skill or chance. A slot machine is a subset of such games.

"Slot Machine Interface Board (SMIB)"—A controller board for a gaming machine resident within the chassis of the gaming machine.

"Dot Impact Printer or Impact Printer"—A printer that makes an image by striking an inked ribbon overlaid on plain paper with a small pin that hammers the ink onto the paper to make a small dot. Impact printers, by their electro-mechanical nature, have a number of moving parts and make a characteristic grinding sound, such as the noise made by most older receipt printers.

"Thermal Printer"—A printer utilizing paper with a heat sensitive side that is imaged using a print head that applies heat in tiny dots (typically 1/200th of an inch in size or smaller) in order to turn the area black. In this manner, images are created by a series of tiny black dots.

"Bill Acceptor"—A device that automatically accepts paper currency by scanning the paper currency and saving the paper currency within the gaming machine. A coin change machine usually has such a device on it, and more recently, so do many slot machines.

"Ticket or Voucher"—An image created on paper stock by a process of imaging dots on the paper stock.

"Paper Jam"—A Condition where the normal feeding of paper through the printer is interrupted.

"Gaming Machine Printer"—A printer including a control module and a printing mechanism. The control module controls the operation of the printing device and communicates with a gaming machine or a host. The printing mechanism, using the features of a printing device, is capable of feeding paper and imaging dots on paper.

Figure 1:
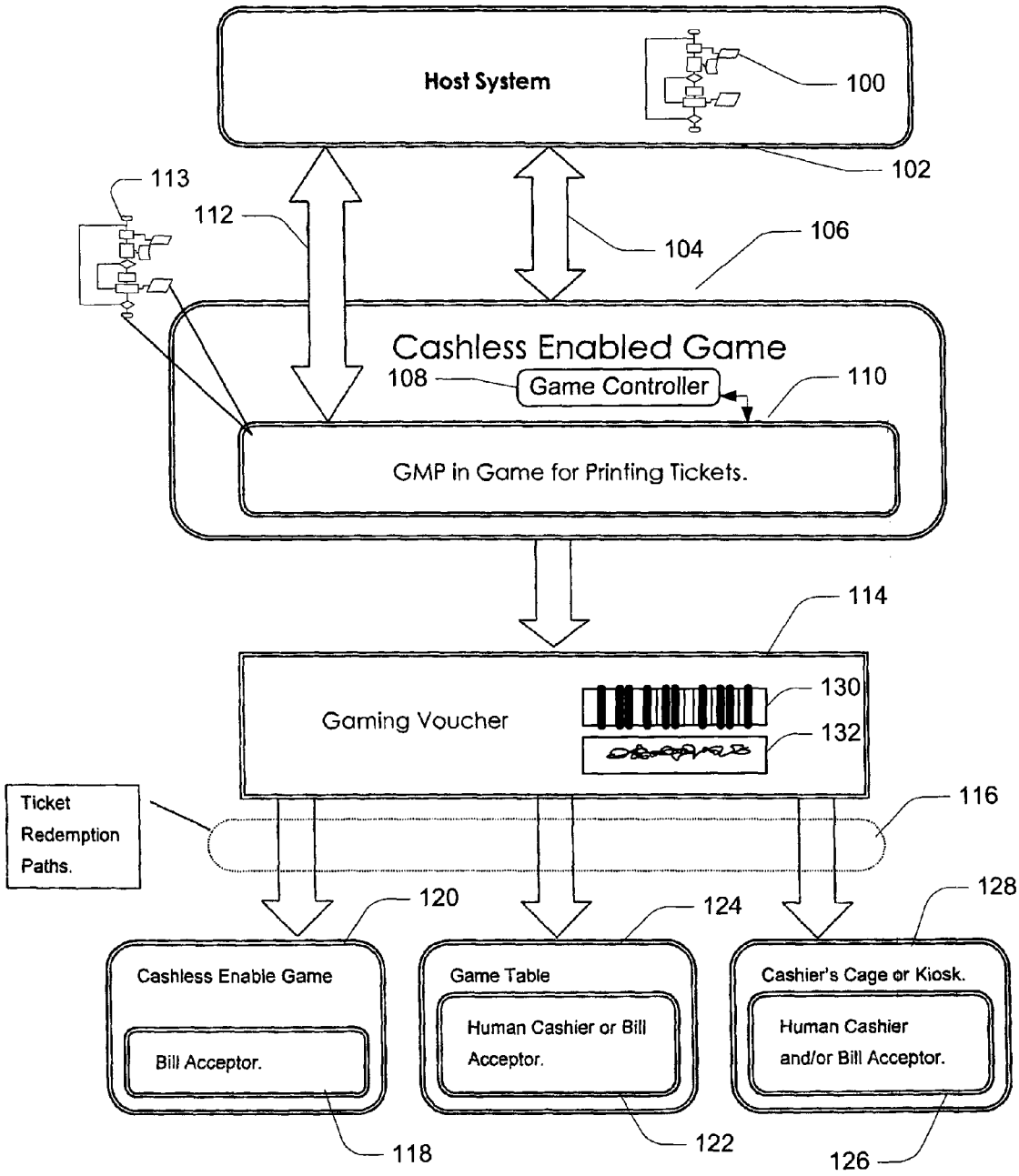
FIG. 1 is block diagram of a cashless enabled gaming machine coupled to a gaming machine printer in accordance with an exemplary embodiment of the present invention.

FIG. 1 is a block diagram of a cashless enabled gaming machine coupled to a gaming machine printer in accordance with an exemplary embodiment of the present invention. A cashless gaming system includes a cashless gaming system controller 100 hosted by a system host 102 coupled 104 to one or more cashless enabled games 106. A cashless enabled game includes a game controller 108 that controls the operation of the cashless enabled game. The game controller is coupled to a gaming machine printer 110. The cashless enabled game uses the gaming machine printer to generate tickets and vouchers 114. The gaming machine printer includes heating and printing algorithms 113 in conjunction with special purpose voucher paper. The voucher includes the cash-out information for a player. The gaming machine printer may also be directly coupled 112 to the host system and cashless gaming controller. The voucher may be redeemed 116 in a variety of ways. The voucher may be redeemed by a human cashier or bill acceptor 122 at a game table 124, or a human cashier or bill acceptor 126 at a cashier's cage or kiosk 128, or by a bill acceptor 118 at another cashless enabled game 120. Redemption is only possible after the voucher passes a verification of account information 130 and validation using security signatures 132 included in the voucher.

Figure 2:
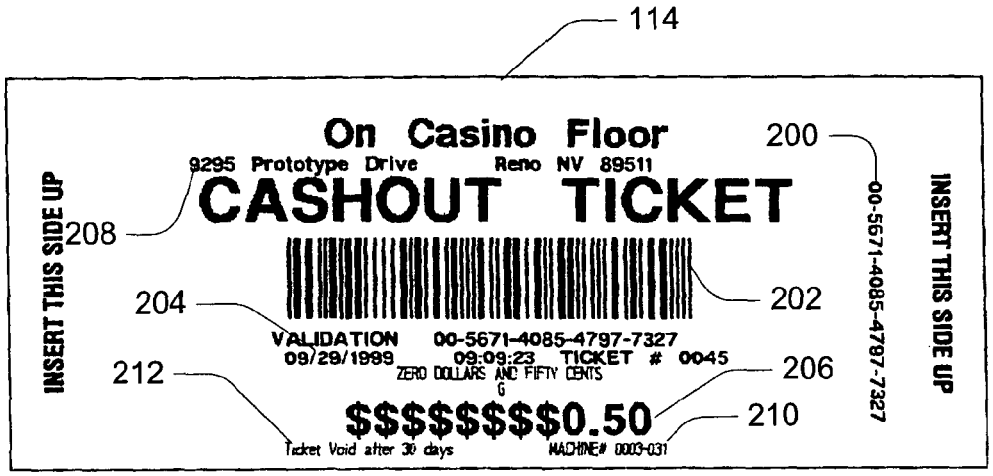
FIG. 2 is an illustration of a gaming voucher in accordance with an exemplary embodiment of the present invention.

FIG. 2 is an illustration of a voucher in accordance with an exemplary embodiment of the present invention. The voucher shown is produced from commands issued by the cashless enabled game to the gaming printer in response to a player's request to cash-out. The voucher 114 includes features such as a validation number, printed in both a human readable form such as a character string 200 and in a machine-readable form such as a bar code 202, time and date stamps 204, cash-out amount 206, casino location information 208, cashless enabled game identifier 210, and an indication of an expiration date 212. The information contained on the voucher is enough to verify that a valid cash-out request was generated at some time, but may not include enough information to detect if a voucher presented for redemption is the original voucher and not a duplicate or forgery.

Figure 3:
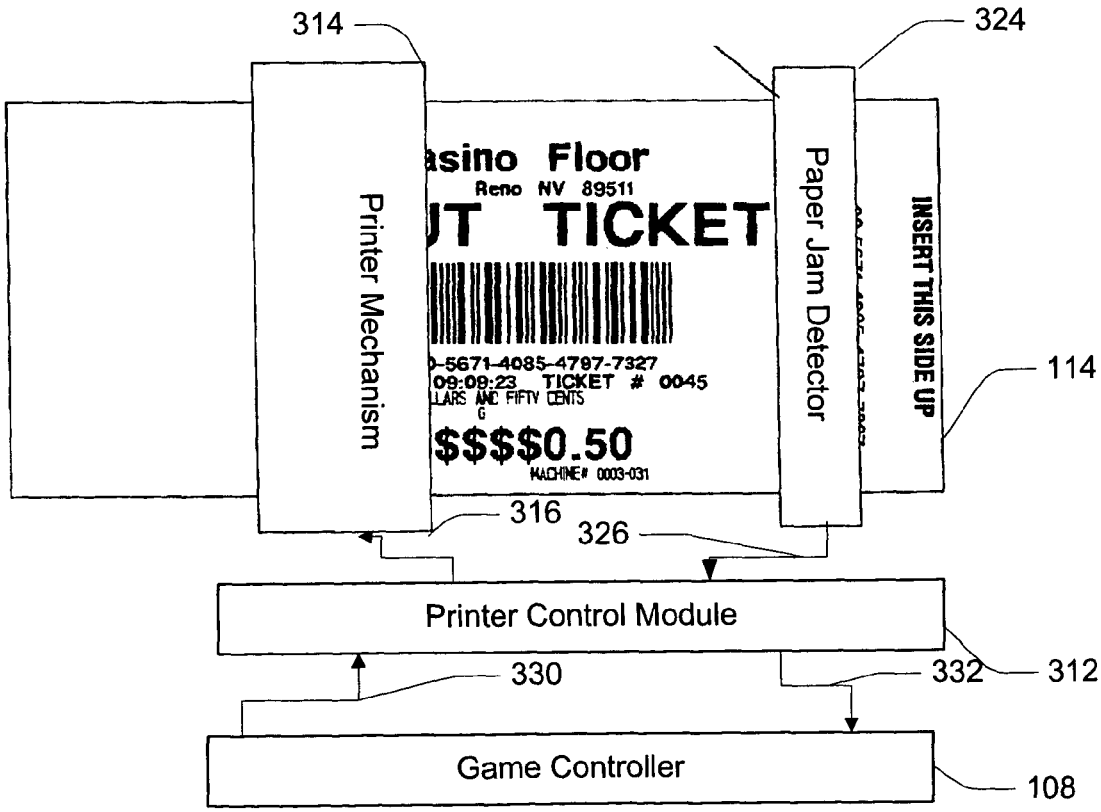
FIG. 3 is a block diagram of a gaming printer including a paper jam detector in accordance with an exemplary embodiment of the present invention.

FIG. 3 is a block diagram of a paper jam detector in accordance with an exemplary embodiment of the present invention. A paper jam detector 324 may be included in a gaming machine printer 106 (FIG. 1). The gaming machine printer includes a gaming printer control module 312 operably coupled to a printing mechanism 314 and the paper jam detector 324.

The printing mechanism receives thermally reactive voucher paper and generates images on the paper to create a voucher 114. The printing mechanism does so by heating a thermal element for each dot that is imaged. The printing mechanism typically creates dot images to a granularity of 8 dots per millimeter, each dot image using a separate thermal element to create a dot image.

A motion detection device integrated within the paper jam detector detects the presence or absence of paper, detects the movement of paper through the gaming machine printer, and determines the speed that the paper is moving through the gaming machine printer.

In slightly more detail, the gaming printer control module transmits printing mechanism control signals 316 to the printing mechanism. The printing mechanism control signals include voucher printing instructions for generation of the voucher by the printing mechanism. The printing mechanism uses the voucher printer instructions to print the voucher. The paper jam detector senses the movement of the printer paper through the printing mechanism and transmits paper movement signals 326 to the gaming printer control module.

In one embodiment of a gaming printer in accordance with the present invention, a game controller 108 is operably coupled to the gaming printer control module. The gaming printer control module receives printer control instructions 330 from the game controller. The gaming printer control module generates paper jam signals 332 indicating whether or not there is a paper jam within the printing mechanism. The gaming printer control module transmits the paper jam signals to the game controller. The game controller uses the paper jam signals to determine if there is a paper jam within the printing mechanism.

Figure 4A:
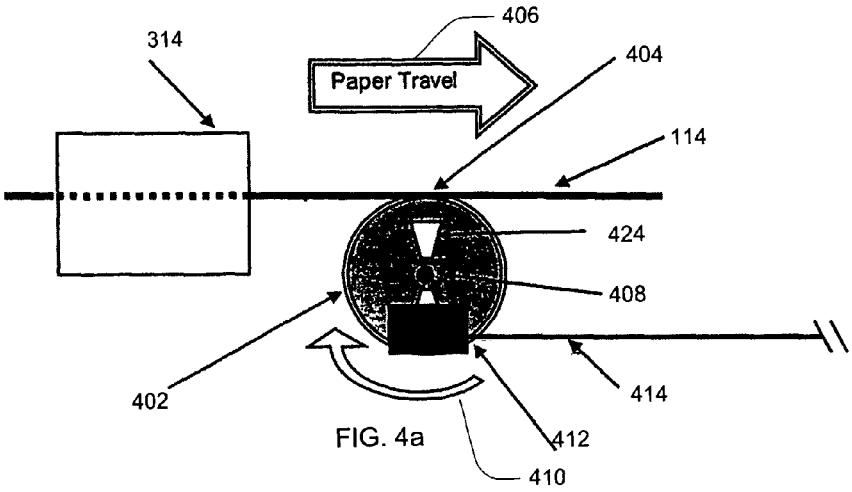
FIGS. 4*a*-4D are semi-schematic views of a paper jam detector employing rollers in accordance with an exemplary embodiment of the present invention.

FIGS. 4*a*-4D are semi-schematic views of a paper jam detector employing rollers in accordance with an exemplary embodiment of the present invention. FIG. 4*a* is a semi-schematic side view of a paper jam detector in accordance with an exemplary embodiment of the present invention. Inside of a gaming printer, a paper voucher 114, being printed by a thermal printing mechanism 314, contacts a paper movement detector such as a roller 402 at a first point 404. As the paper moves in the indicated direction 406, the paper movement causes the roller to turn about a shaft 408 in a clockwise direction as indicated by the direction arrow 410. The paper jam detector further includes a roller sensor 412 coupled to the roller. The roller sensor generates a paper movement signal 414 in response to movement by the roller.

Figure 4B:
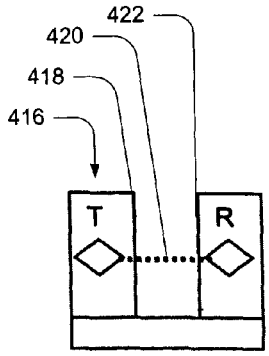

FIG. 4*b* is a semi-schematic diagram of an interrupter style optical device 416 that may be used as a roller sensor. An optical transmitter 418 transmits an optical signal 420 that is received by an optical receiver 422. In operation, the optical sensor generates a signal when an object interrupts the optical signal transmitted from the optical transmitter to the optical receiver.

Referring again to FIG. 4*a*, the roller is optically coupled to the roller sensor by one or more shutters 424 mechanically coupled to the roller. The shutters are positioned relative to optical sensor of FIG. 4*b* such that, as the paper jam detector roller rotates, the shutter temporarily interrupts the optical signal between the optical transmitter and the optical receiver. In response to the intermittently interrupted optical signal, the sensor generates a paper movement signal indicating the movement of paper through the printing mechanism.

In one paper jam detector in accordance with an exemplary embodiment of the present invention, the roller sensor is a quadrature encoder device, containing more that one set of shutters and optical sensors. In this embodiment, the paper movement signal generated by the sensor includes a direction component, allowing the paper jam detector to generate a paper movement signal indicating the direction of paper travel through the printing mechanism.

Figure 4C:
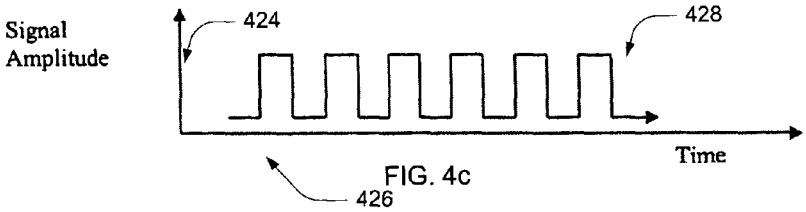

FIG. 4*c* is a graph depicting a paper movement signal generated by a roller sensor in accordance with an exemplary embodiment of the present invention. The amplitude of the paper movement signal is indicated along the Y-axis 424 and passage of time is indicated along the X axis 426. A paper movement signal 428 is characterized as a square wave pulse train indicating the rotational velocity of the paper jam detector roller. The output of the roller sensor is transmitted to a gaming machine control module for analysis. By analyzing the rate of change in the signal, the control module can determine if the paper is moving. In addition, the control module can determine the speed of the paper movement by measuring the period or frequency of the paper movement signal.

Figure 4D:
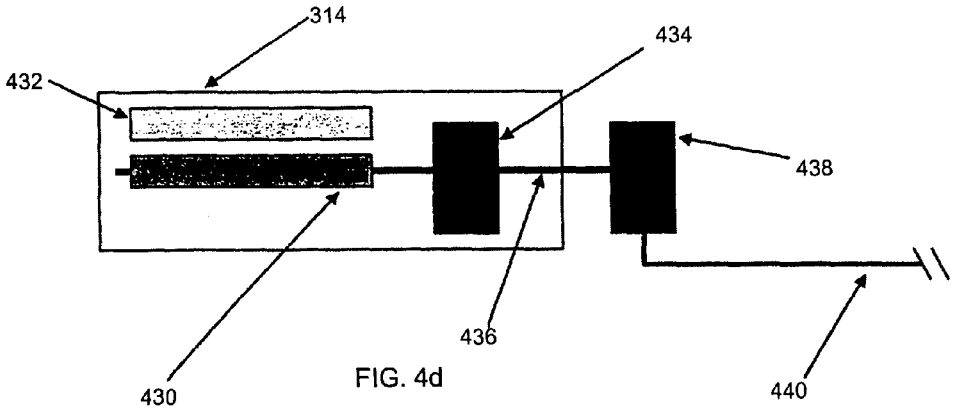

FIG. 4*d* is a semi-schematic drawing of a paper jam detector that is coupled to a paper drive mechanism that is part of a printing mechanism in accordance with an exemplary embodiment of the present invention. In this embodiment, a paper jam detector 438 is mechanically coupled to a platen roller 430 used in a paper drive mechanism. The platen roller may be located anywhere within the paper drive mechanism, such as opposite a printer head 432. In other embodiments, the paper jam detector is coupled to the printing mechanism drive motor 434 or other motor driven parts inside of a printing mechanism through a mechanical coupling 436.

The paper jam detector uses this mechanical coupling to determine whether or not the printing mechanism is operating. Specifically if the platen roller is rotating or the drive motor is operating. In response to the motion of the printing mechanism, the paper jam detector generates a paper drive signal that may be used to infer whether or not a paper jam has occurred within the printing mechanism. For example, the printing mechanism may be in a jammed condition as a result of a mechanical failure or an obstruction. If so, the printing mechanism prevents the movement of the paper drive mechanism, and in turn the movement of the paper.

In other paper jam detectors in accordance various embodiment of the present invention, other types of sensors are used to detect movement of the roller platen or printing mechanism. Other non-contacting types of sensing elements may be used with appropriate modification of the one or more shutters. For example, the sensor element may employ capacitance sensors or other types of proximity detecting sensors. In addition, reflective optical sensors may be used to detect movement of the shutters. The roller platen may be mechanically coupled to the sensor as well in which case sensors employing resistive elements or limit switches may be used to detect mechanical movement by the roller platen. In addition, sensors with resistive elements or limit switches may be used to detect movement when mechanically coupled to the paper drive or printing mechanism.

Figure 5A:
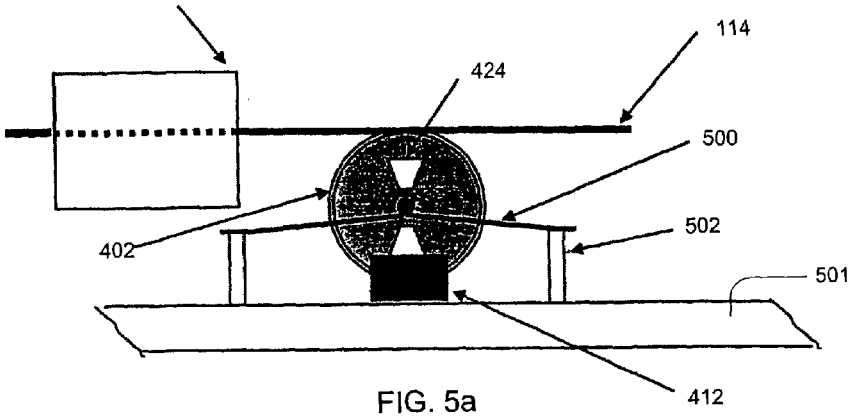
FIGS. 5*a*-5*c* are semi-schematic views of an articulated paper jam detector in accordance with an exemplary embodiment of the present invention.
Figure 5B:
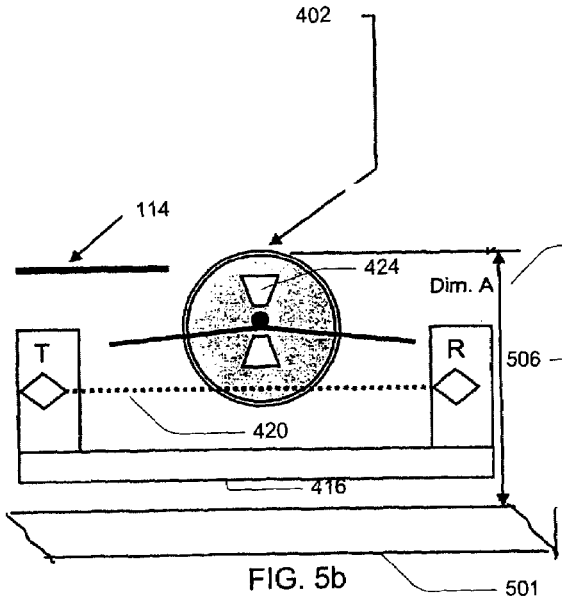
Figure 5C:
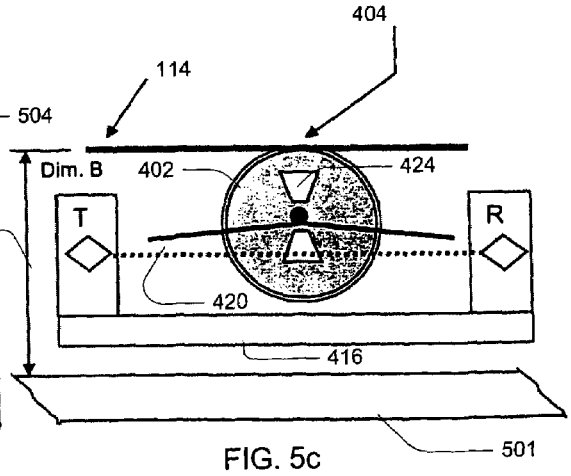

FIGS. 5*a*-5*c* are semi-schematic views of an articulating paper jam detector in accordance with an exemplary embodiment of the present invention. The previously described paper jam detector roller 402 may be rotatably coupled to a moveable support 500. The support is moveably coupled to a mounting base 501 by one or more elastic members, such as spring mount 502. The elastic members urge the moveable support toward the paper path of a paper voucher 114 being printed. The roller is also urged toward the paper voucher such that the roller contacts the paper voucher as the paper voucher is being printed. The roller further includes one or more shutters 424 that are positioned so that, as the roller rotates about a shaft 408, the shutters intermittently interrupt an optical path in an optical sensor 412 as previously described.

FIG. 5*b* is a semi-schematic drawing of the paper jam roller of FIG. 5*a* in a first position. The paper jam detector roller 402 . As shown, the paper jam detector roller is urged by one or more elastic member 502 to move further away from the mounting base 501 and into the path of a paper voucher 114 that is being printed. As the paper voucher has not reached the roller yet, the paper voucher does not impede the roller and the roller occludes part of the paper path. In this first position, as indicated by dimension line 504, the one or more shutters 424 do not occlude a previously described optical path 420 within a previously described interrupter style optical device 416 used as a roller sensor. With the roller and coupled shutter in this position, the shutter is out of the sensor path. In response, the roller sensor generates a constant signal level of a specified value indicating the amount of movement or articulation of the roller. This constant signal may be interpreted in digital terms as a logical 1 or high when the signal is received by a gaming printer control module. As noted in the discussion of FIG. 4*c*, a paper movement signal generated by a paper jam detector may include a timer varying component. The frequency of the time varying component may be used to determine the speed of paper movement within the printing mechanism. Therefore, a paper movement signal without a time varying component may indicate that there is no voucher paper in the print drive.

FIG. 5*c* is a semi-schematic drawing of the paper jam roller of FIG. 5*a* in a second position. As shown, the paper jam detector roller 402 is in contact at point 404 with a paper voucher 114 being printed. Contact with the paper voucher prevents the one or more elastic members 502 (of FIG. 5*a*) from urging the paper jam detector roller into the path of the paper voucher. As such, the paper jam detector roller is pushed closer to the mounting base 501, as indicated by dimension line 506. Dimension line 506 as illustrated is relatively shorter than dimension line 504 (of FIG. 5*b*) indicating that the paper jam roller is not occluding a portion of the paper voucher's path. In this position, the one or more shutters 424 occlude a previously described optical path 420 within a previously described interrupter style optical device 416 used as a roller sensor. If the paper voucher is stationary, then the sensor may generate a constant signal level of a different specified value than the sensor generates in the first position illustrated in FIG. 5*c*. This different specified value indicating a reduced level of articulation by the roller may be interpreted as a logical 0 or low, when the signal is received by a gaming machine printer control module.

In operation, as shown in FIG. 5*b* and FIG. 5*c*, a paper jam detector can detect the absence or presence of paper in the normal path that the paper follows as the paper moves through the printing mechanism. As illustrated, the paper jam detector can make the determination without the paper voucher actually moving within the printing mechanism. In addition, the paper jam detector, knowing that the motor in the print mechanism is commanded to move by a gaming printer's control module, can detect the absence or presence of paper in the normal path that the paper follows as the paper moves through the printer. Thus the paper jam detector can detect a paper jam condition if the paper movement signal from the sensor is not alternating creating a wave form as shown in FIG. 4*c*. The paper jam detector can also determine if the paper is moving at the correct speed through the paper path by analyzing the period or frequency of the paper movement signal created by the sensor.

The determination of the speed of the paper moving through the printer is important in identifying the situation when a player, or other person, is pulling on the voucher prior to the completion of the printing on the voucher. Pulling on the voucher will change the speed of the paper moving past the paper jam detector and change the paper movement signal output from the sensor which can be detected by a gaming printer's control module. Although, not technically a paper jam, this event does occur in the field and can cause the following voucher to become jammed by tearing the partially printed voucher into multiple parts. The paper jam detector can detect this event and take corrective action or announce the condition to a gaming machine or host for decision making purposes.

Figure 6A:
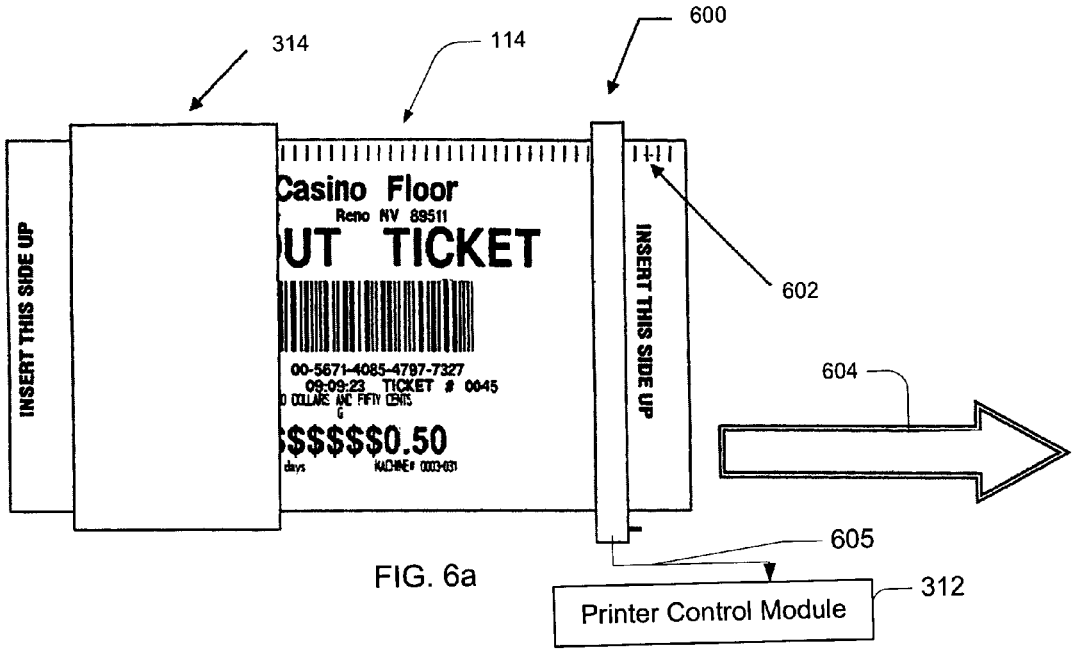
FIG. 6 is a semi-schematic diagram of a paper jam detector using an optical scanning device in accordance with an exemplary embodiment of the present invention.

FIG. 6 is a semi-schematic diagram of a paper jam detector using an optical scanning device in accordance with an exemplary embodiment of the present invention. An optical scanning device 600 is capable of detecting individual dot images on a paper voucher 114 being printed by a printing mechanism 314 and moving under the optical scanning device. Dot images may have a granularity of approximately 8 to 10 dots per millimeter. As the paper is moved under the scanner by the printing mechanism or other means, as indicated by direction of paper travel arrow 604, the optical scanner reads index marks 602 composed of dot images generated by the printing mechanism. In response to successive index marks, the optical scanning device generates a paper movement signal 605 having a time varying component similar to the paper movement signal 428 shown in FIG. 4*c*. The paper movement signal is transmitted to a gaming printer's control module 312. The control module interprets the paper movement signal to determine the speed and direction of paper movement as previously described.

Figure 6B:
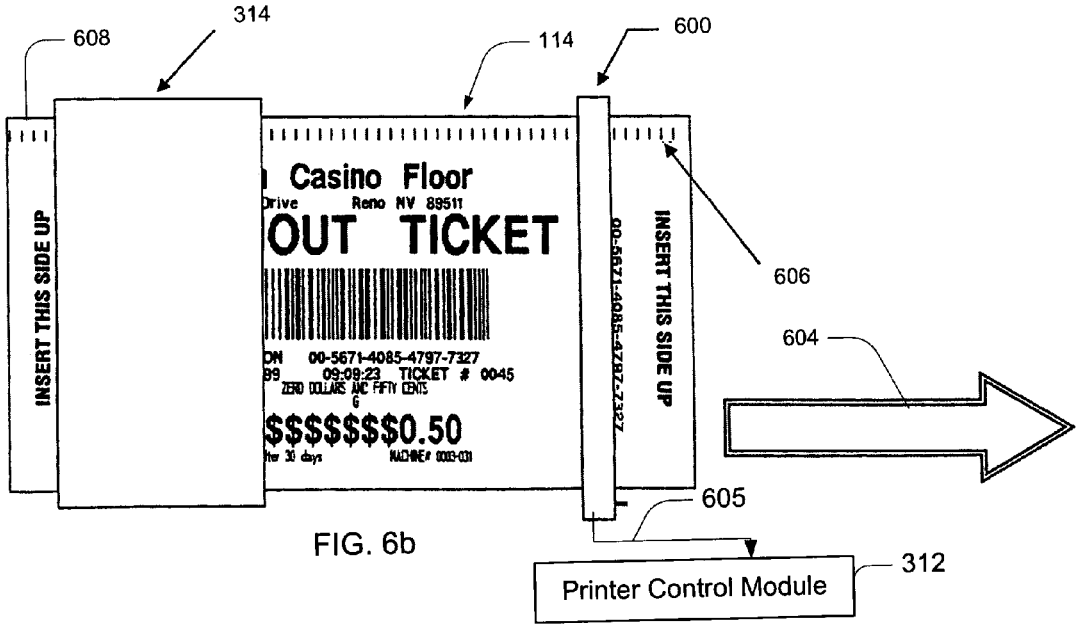

FIG. 6*b* is a semi-schematic diagram depicting use of pre-printed index marks for optical scanning in accordance with an exemplary embodiment of the present invention. An optical scanning device 600 is capable of detecting individual dot images on a paper voucher 114 being printed by a printing mechanism 314 and moving under the optical scanning device as previously described. As the paper is moved under the scanner by the printing mechanism or other means, as indicated by direction of paper travel arrow 604, the optical scanner reads index marks 606. In response to the successive index marks, the optical scanning device generates a paper movement signal 605 having a time varying component similar to the paper movement signal 428 shown in FIG. 4*c*. The paper movement signal is transmitted to a gaming printer's control module 312. The control module interprets the paper movement signal to determine the speed and direction of paper movement as previously described. In contrast to the process illustrated in FIG. 6*a*, the index marks are preprinted onto voucher paper stock before the printing mechanism prints a voucher, as indicated by pre-printed index marks 608.

Figure 7:
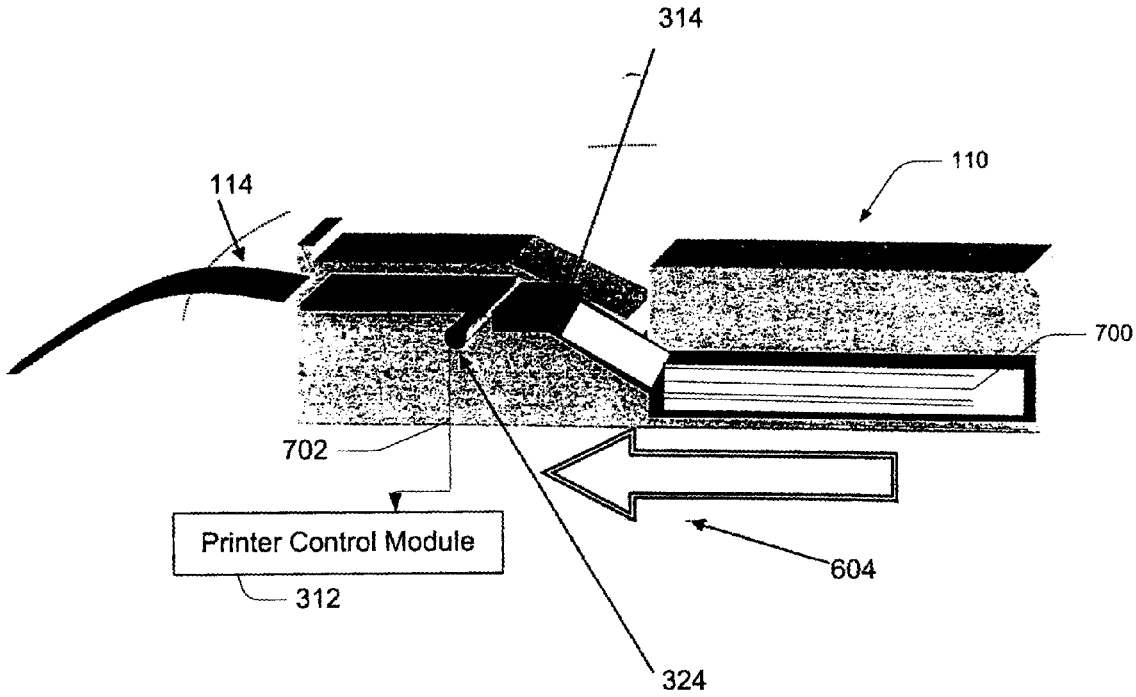
FIG. 7 is a semi-schematic perspective view of a paper jam detector as included in a gaming machine printer in accordance with an exemplary embodiment of the present invention.

FIG. 7 is a semi-schematic perspective view of a paper jam detector as included in a gaming machine printer in accordance with an exemplary embodiment of the present invention. A gaming machine printer 110 may include an internal printing mechanism 314. The printing mechanism draws voucher paper stock 700 from an internal storage location and prints vouchers, such as voucher 114, for presentation to gaming machine players. The direction the voucher paper takes through the gaming machine printer is indicated by paper direction arrow 604. A paper jam detector 324 may be included in the gaming machine printer along the path taken by the voucher paper as the voucher paper passes through the gaming printer. The paper jam detector generates a paper movement signal 702 that is transmitted to the gaming printer's control module 312.

Figure 8:
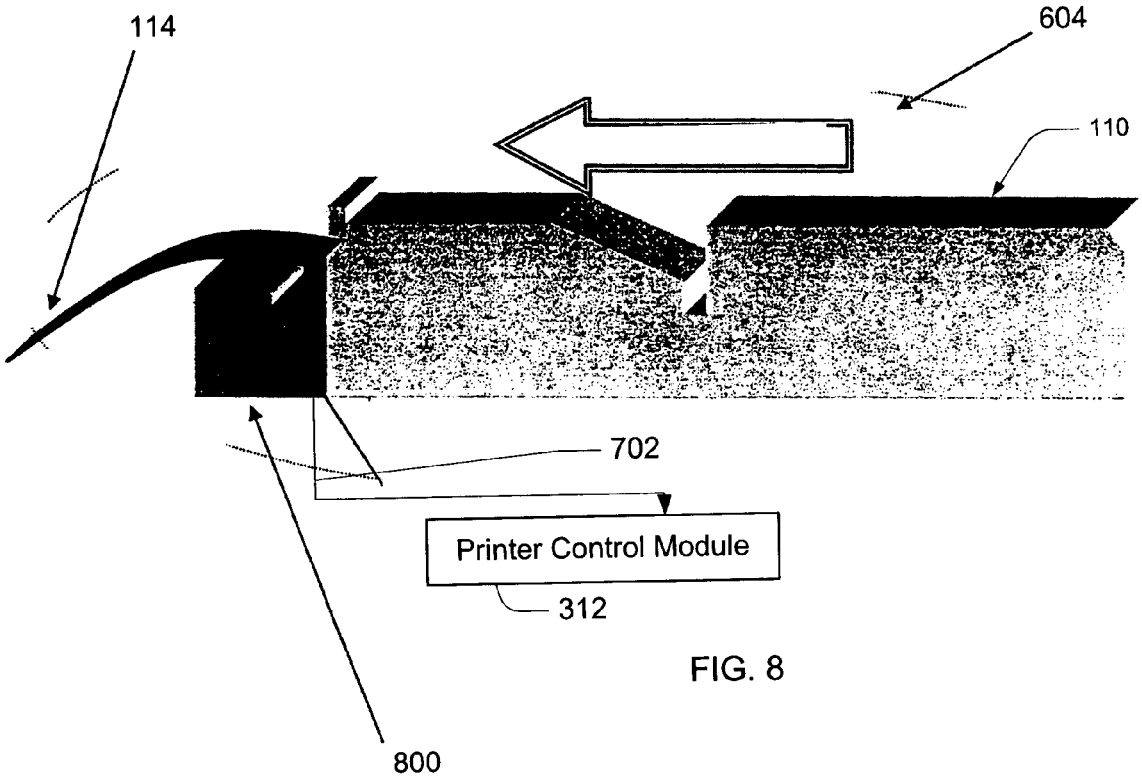
FIG. 8 is a semi-schematic perspective view of a paper jam detector as a stand alone device in accordance with an exemplary embodiment of the present invention.

FIG. 8 is a semi-schematic perspective view of a paper jam detector as a stand alone device in accordance with an exemplary embodiment of the present invention. A gaming machine printer 110 may print vouchers, such as voucher 114, for presentation to a gaming machine player. The direction the voucher paper takes through the gaming machine printer is indicated by paper direction arrow 604. A stand alone paper jam detector 800 may be attached to the exterior of the gaming machine printer such that the voucher passes through the paper jam detector before the voucher is presented to the gaming machine user. The paper jam detector generates a paper movement signal 702 that is transmitted to the gaming printer's control module 312 for further processing as previously described.

Figure 9:
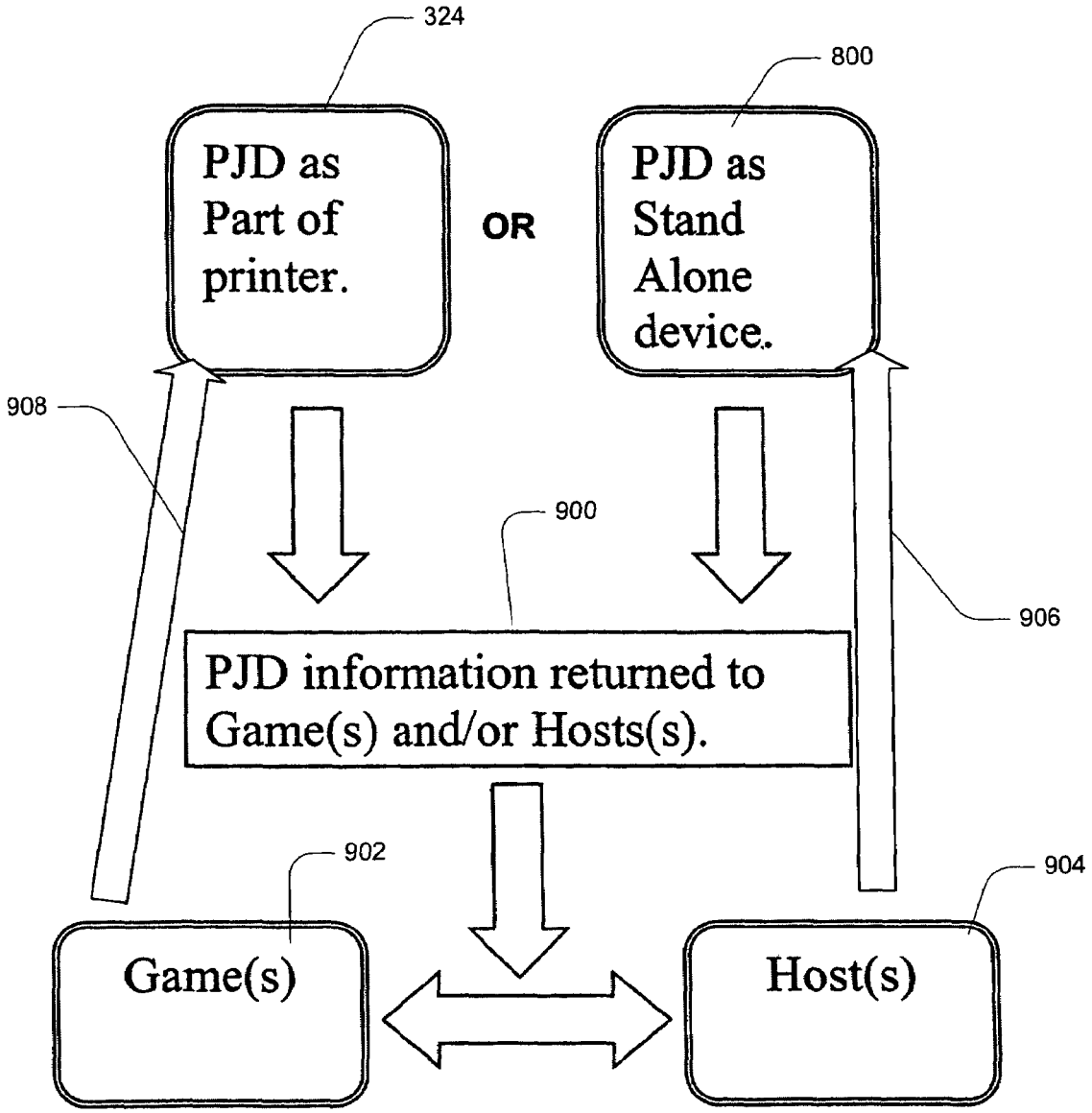
FIG. 9 is a process flow diagram depicting using information received from a paper jam detector in accordance with an exemplary embodiment of the present invention.

FIG. 9 is a process flow diagram of using information received from a paper jam detector in accordance with an exemplary embodiment of the present invention. A paper jam detector 324 included as a component of a gaming machine printer or a stand alone paper jam detector 800 may make local decisions regarding the handling of paper jam conditions. In addition, the paper jam detectors can transmit paper jam or paper movement signals 900 to a gaming machine 902 or another host 904. In addition, the paper jam detectors may receive directions from the gaming machine or host as to what actions to take upon detecting a paper jam. Actions might include stopping the gaming machine printer, calling an attendant or technician, or other actions as dictated by the gaming machine or host.

Figure 10:
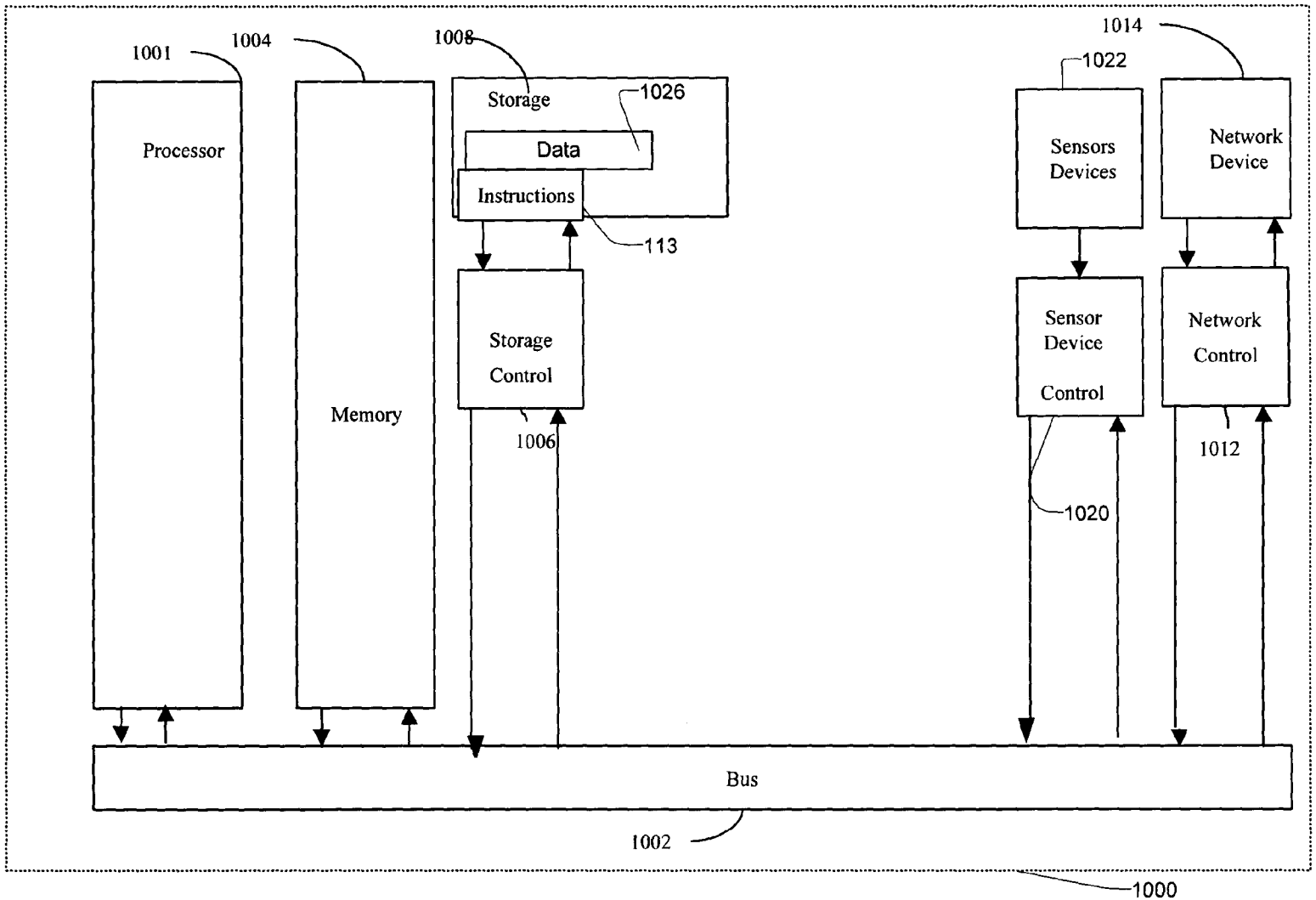
FIG. 10 is an architecture diagram of a control module for a paper jam detector in accordance with an exemplary embodiment of the present invention.

FIG. 10 is an architecture diagram of a control module for a paper jam detector in accordance with an exemplary embodiment of the present invention. As previously described, a paper jam detector may be included as a component of a gaming machine printer or may be a stand alone device. If the paper jam detector is integral to a gaming machine printer, the paper jam detector may transmit paper jam and paper movement signals to the gaming machine printer's control module. Otherwise, the paper jam detector may preprocess some of the signals internally and transmit only high level signals to a gaming machine printer. A control module 1000 for a paper jam detector includes a processor 1001 operatively coupled via a system bus 1002 to a main memory 1004. The processor is also coupled to a storage device 1008 via a storage controller 1006 and the bus. The storage device includes stored program instructions 1024 and data 1026 used by the paper jam detector. In operation, program instructions implementing a paper jam detector are stored on the storage device until the processor retrieves the program instructions and stores them in the main memory. The processor then executes the computer program instructions stored in the main memory and operates on the data stored in the storage device to implement the features of a paper jam detector as described above.

The processor is further coupled to sensor devices 1022 by an input device controller 1020 via the bus. Example input devices include sensors that the paper jam detector uses to detect paper movement through a gaming machine printer's printing mechanism as previously described. The processor receives input device signals from the sensor devices via the input device controller and the bus and uses the sensor device signals to detect the state of the paper in a gaming machine printer.

The processor may be further coupled to a network device 1014 via a network device controller 1012 and the bus. The process uses the network device to communicate with other processing systems, such as a gaming machine printer, gaming machine, or other host as previously described.

Although this invention has been described in certain specific embodiments, many additional modifications and variations would be apparent to those skilled in the art. It is therefore to be understood that this invention may be practiced otherwise than as specifically described. Thus, the present embodiments of the invention should be considered in all respects as illustrative and not restrictive, the scope of the invention to be determined by any claims supported by this application and the claims' equivalents rather than the foregoing description.

What is claimed is:

1. A method of detecting pulling of a ticket in a gaming machine printer, comprising:

coupling a paper movement detector to paper stock used in the gaming machine printer to print the ticket;

generating by the paper movement detector a paper movement signal in response to movement by the paper stock, the paper movement signal including a speed of movement component indicating a speed of movement of the paper stock; and detecting that the ticket is being pulled by interpreting the speed of movement component of the paper movement signal.

2. The method of claim 1, wherein the paper movement detector is mechanically coupled to the paper stock.

3. The method of claim 2, wherein coupling the paper movement detector to the paper stock further comprises:

mechanically coupling a roller to the paper stock; and coupling a roller sensor to the roller wherein the roller sensor generates the paper movement signal in response to movement by the roller.

4. The method of claim 3, wherein the roller is articulating.

5. The method of claim 3, wherein the paper movement signal is a square wave pulse train indicating the rotational velocity of the roller, the method further comprising determining the speed of movement of the paper stock by measuring a frequency of the paper movement signal.

6. The method of claim 3, wherein the roller sensor is a quadrature encoder device having more than one set of shutters and optical sensors and the paper movement signal further includes a directional component.

7. The method of claim 3, wherein the roller sensor is an optical sensor.

8. The method of claim 3, wherein the roller sensor is a capacitance sensor.

9. The method of claim 1, wherein the paper movement detector is optically coupled to the paper stock.

10. The method of claim 9, further comprising reading by the paper movement detector a series of index marks on the paper stock.

11. The method of claim 10, further comprising printing the series of index marks onto the paper stock by the gaming machine printer as the paper moves.

12. The method of claim 10, wherein the series of index marks are pre-printed on the paper stock.

13. The method of claim 1, wherein the paper movement signal is a square wave pulse train indicating the speed of paper stock movement, the method further comprising determining the speed of paper stock movement by measuring a frequency of the paper movement signal.

14. A ticket pulling detector in a gaming printer, comprising:

a paper movement detector coupled to paper stock used in the gaming machine printer to print the ticket, the paper movement detector generating a paper movement signal in response to movement by the paper stock, the paper movement signal including a speed of movement component indicating a speed of movement of the paper stock; and a control module coupled to the paper movement detector and adapted to detect when the ticket is being pulled by interpreting the speed of movement component of the paper movement signal.

15. The ticket pulling detector of claim 14, wherein the paper movement detector is mechanically coupled to the paper stock.

16. The ticket pulling detector of claim 15, the paper movement detector further comprising:

a roller mechanically coupled to the paper stock; and a roller sensor coupled to the roller wherein the roller sensor generates the paper movement signal in response to movement by the roller.

17. The ticket pulling dector of claim 16, wherein the paper movement signal is a square wave pulse train indicating the rotational velocity of the roller, the control module further adapted to determine the speed of movement of the paper stock by measuring a frequency of the paper movement signal.

18. The ticket pulling dector of claim 16, wherein the roller sensor is a quadrature encoder device having more than one set of shutters and optical sensors and the paper movement signal further includes a directional component.

19. The ticket pulling dector of claim 14, wherein the paper movement detector is an optical scanning device that reads the presence of a series of index marks on the paper stock.

20. The ticket pulling dector of claim 19, wherein the paper movement signal is a square wave pulse train generated by the optical scanning device in response to the series of index marks, the control module further adapted to determine the speed of movement of the paper stock by measuring a frequency of the paper movement signal.

* * * * *

UNITED STATES PATENT AND TRADEMARK OFFICE

CERTIFICATE OF CORRECTION

PATENT NO. : 7,347,782 B2
APPLICATION NO. : 10/640495
DATED : March 25, 2008
INVENTOR(S) : Hilbert It is certified that error appears in the above-identified patent and that said Letters Patent is hereby corrected as shown below:

COLUMN 2:
Line 41, “to s” should read -- to a --.

COLUMN 6:
Line 56, “ating. Specifically if” should read -- ating, specifically whether --.

COLUMN 7:
Line 29, “The paper jam detector” should be deleted;
Line 30, “roller 402.” should be deleted;
Line 30, “roller is” should read -- roller 402 is --;
Line 31, “member” should read -- members --; and
Line 48, “timer” should read -- time --.

COLUMN 12:
Line 20, “dector” should read -- detector --; and
Line 24, “dector” should read -- detector --.

Signed and Sealed this

Twenty-ninth Day of July, 2008

JON W. DUDAS
*Director of the United States Patent and Trademark Office*